US010107506B2

(12) United States Patent
Kraft et al.

(10) Patent No.: US 10,107,506 B2
(45) Date of Patent: Oct. 23, 2018

(54) HEAT EXCHANGER WITH DIFFERENTIATED RESISTANCE FLOWPATHS

(71) Applicant: Trane International Inc., Piscataway, NJ (US)

(72) Inventors: Wayne Neal Kraft, Tyler, TX (US); Anosh Porus Wadia, Tyler, TX (US); Delbert Steven Christopher, Reklaw, TX (US); Benjamin Farlen Hudgens, Van, TX (US)

(73) Assignee: Trane International Inc., Piscataway, NJ (US)

( * ) Notice: Subject to any disclaimer, the term of this patent is extended or adjusted under 35 U.S.C. 154(b) by 611 days.

(21) Appl. No.: 14/244,696

(22) Filed: Apr. 3, 2014

(65) Prior Publication Data

US 2014/0299305 A1 Oct. 9, 2014

Related U.S. Application Data

(60) Provisional application No. 61/808,064, filed on Apr. 3, 2013.

(51) Int. Cl.

| | |
|---|---|
| ***F28F 1/20*** | (2006.01) |
| ***F24F 1/00*** | (2011.01) |
| ***F28F 13/06*** | (2006.01) |
| ***F28D 1/047*** | (2006.01) |
| ***F28F 1/32*** | (2006.01) |

(Continued)

(52) U.S. Cl.

CPC ..... *F24F 1/0059* (2013.01); *F28D 1/0477* (2013.01); *F28F 1/32* (2013.01); *F28F 1/34* (2013.01); *F28F 13/06* (2013.01); *F24D 2200/123* (2013.01); *F28D 2001/028* (2013.01);

(Continued)

(58) Field of Classification Search

CPC ..... F28F 1/04; F28F 1/045; F28F 1/38; F28F 1/30; F28F 1/325; F28F 1/20; F28F 13/08; F28F 13/02; F28F 13/06; F28F 13/04; F25D 2317/063; F24F 1/0059; F28D 1/0477

See application file for complete search history.

(56) References Cited

U.S. PATENT DOCUMENTS 1,260,352 A * 3/1918 Eligh ..... F28F 1/325 165/151
2,205,984 A * 6/1940 Kromas ..... F28D 1/0477 165/148

(Continued)

*Primary Examiner* — Claire Rojohn, III
(74) *Attorney, Agent, or Firm* — Conley Rose, P.C.; J. Robert Brown, Jr.

(57) ABSTRACT

Systems and methods are disclosed which may include (1) providing a preselected and/or non-uniform airflow distribution output from a heat exchanger, (2) selectively directing air through a relatively lower resistance flowpath to manage an airflow characteristic and/or distribution downstream of the heat exchanger, (3) providing an HVAC system comprising a heat exchanger comprising a fin arrangement configured to cause relatively more air to contact a selected component that lies either upstream or downstream relative to the heat exchanger, and (4) receiving a relatively uniform airflow into a heat exchanger and outputting an airflow comprising a localized increased airflow rate. A heat exchanger comprising differentiated resistance flowpaths may selectively affect a direction and/or localized flow rate or distribution of an airflow exiting the heat exchanger.

18 Claims, 9 Drawing Sheets

(51) Int. Cl.
*F28F 1/34* (2006.01)
*F28D 1/02* (2006.01)

(52) U.S. Cl.
CPC ..... *F28F 2215/04* (2013.01); *F28F 2275/125* (2013.01)

(56) References Cited

U.S. PATENT DOCUMENTS 2,540,339 A * 2/1951 Kritzer ..... F28F 1/325 126/378.1
3,543,843 A * 12/1970 Gunter ..... F28B 1/06 165/111
4,209,061 A * 6/1980 Schwemin ..... F02G 1/057 165/10
4,449,511 A 5/1984 Hays et al.
4,542,734 A 9/1985 Trent et al.
4,848,314 A * 7/1989 Bentley ..... F28F 19/04 126/110 R
5,178,124 A * 1/1993 Lu ..... F24H 3/105 126/110 R
5,347,980 A * 9/1994 Shellenberger ..... F24H 3/087 126/110 R
5,353,868 A * 10/1994 Abbott ..... B21D 53/045 165/147
5,406,933 A * 4/1995 Lu ..... F24H 3/087 126/110 R
5,439,050 A * 8/1995 Waterman ..... F24H 3/105 126/110 R
5,448,986 A * 9/1995 Christopher ..... F24H 3/105 126/110 R
5,480,678 A * 1/1996 Rudolph ..... C04B 35/83 118/715
5,482,027 A * 1/1996 Stiller ..... F23K 1/04 110/106
6,006,741 A * 12/1999 Daddis, Jr. ..... F24H 3/087 126/110 R
8,826,901 B2 * 9/2014 Haydock ..... F23J 15/06 126/110 R
2002/0014326 A1 * 2/2002 Nakado ..... F28D 1/0341 165/153
2002/0026999 A1 * 3/2002 Wu ..... F28D 9/0012 165/167
2003/0010481 A1 * 1/2003 Northrop ..... F28F 1/24 165/168
2003/0150601 A1 * 8/2003 Park ..... F28F 1/325 165/151
2003/0159814 A1 * 8/2003 Sin ..... F25B 39/02 165/151
2005/0092316 A1 * 5/2005 Schonberger, Sr. ..... F23M 9/06 126/110 R
2005/0257921 A1 * 11/2005 Hu ..... F28D 1/0443 165/140
2007/0170272 A1 * 7/2007 Mukomilow ..... F24D 3/1066 237/19
2008/0006226 A1 * 1/2008 Takeda ..... F24H 1/40 122/18.1
2008/0061160 A1 * 3/2008 Ootomo ..... F24H 1/40 237/8 R
2008/0314378 A1 * 12/2008 Khan ..... F24H 3/087 126/99 R
2009/0090486 A1 * 4/2009 Geskes ..... F28D 7/06 165/51
2010/0032148 A1 * 2/2010 Bermhult ..... F28D 9/0043 165/166
2010/0089556 A1 * 4/2010 Yang ..... F28D 1/0477 165/145
2012/0247444 A1 * 10/2012 Sherrow ..... F24H 9/14 126/116 R
2013/0248150 A1 * 9/2013 Ninagawa ..... F28F 1/325 165/104.19
2013/0333868 A1 * 12/2013 Noman ..... F28F 3/12 165/173
2014/0014291 A1 * 1/2014 Kraft ..... F28F 27/00 165/11.1
2014/0190425 A1 * 7/2014 Oohigashi ..... F24H 9/0031 122/18.4
2014/0299305 A1 * 10/2014 Kraft ..... F24F 1/0059 165/181
2014/0352930 A1 * 12/2014 Hanks ..... F28D 1/0461 165/121
2015/0241131 A1 * 8/2015 Katoh ..... F28D 1/05366 165/140
2017/0184349 A1 * 6/2017 Ooshita ..... F24D 17/0036
2017/0276440 A1 * 9/2017 Kenworthy ..... F28F 13/003
2018/0023895 A1 * 1/2018 Kraft ..... F28D 1/0478

* cited by examiner

HEAT EXCHANGER WITH DIFFERENTIATED RESISTANCE FLOWPATHS

CROSS-REFERENCE TO RELATED APPLICATIONS

The present application claims priority under 35 U.S.C. 119(e) to U.S. Provisional Patent Application No. 61/808,064 filed on Apr. 3, 2013 by Kraft, et al. and entitled "Heat Exchanger with Differentiated Resistance Flowpaths," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may comprise components and/or spaces that, unless managed, may approach undesirable and/or relatively extreme temperatures. In some cases, baffles and/or other air diversion devices may be utilized to manage an amount of air that encounters the above-described components. However, in some cases, baffles and/or other air diversion devices may be undesirable for pressure loss and manufacturing efficiency.

SUMMARY

In some embodiments of the disclosure, a heat exchanger is disclosed as comprising at least one tube and a first differentiated resistance flowpath comprising at least one of (1) a reduced amount of fin material in the first differentiated resistance flowpath relative to a remainder of the heat exchanger and (2) a reduced amount of refrigerant tube material in the first differentiated resistance flowpath relative to a remainder of the heat exchanger.

In other embodiments of the disclosure, an HVAC system is disclosed as comprising a heat exchanger, comprising: at least one tube; and a first differentiated resistance flowpath comprising at least one of (1) a reduced amount of fin material in the first differentiated resistance flowpath relative to a remainder of the heat exchanger and (2) a reduced amount of refrigerant tube material in the first differentiated resistance flowpath relative to a remainder of the heat exchanger.

In yet other embodiments of the disclosure, a method of producing a fin and tube heat exchanger is disclosed as comprising: aligning a plurality of fins to receive a plurality of refrigerant tubes therethrough; inserting the refrigerant tubes through the fins; laterally bracing adjacent refrigerant tubes; and expanding the refrigerant tubes.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

This disclosure provides, in some embodiments, systems and methods for (1) providing a preselected and/or non-uniform airflow distribution output from a heat exchanger, (2) selectively directing air through a relatively lower resistance flowpath to manage an airflow characteristic and/or distribution downstream of the heat exchanger, (3) providing an HVAC system comprising a heat exchanger comprising a fin arrangement configured to cause relatively more air to contact a selected component that lies either upstream or downstream relative to the heat exchanger, and (4) receiving a relatively uniform airflow into a heat exchanger and outputting an airflow comprising a localized increased airflow rate. In some embodiments, a heat exchanger comprising differentiated resistance flowpaths may selectively affect a direction and/or localized flow rate of air exiting the heat exchanger.

Figure 1:
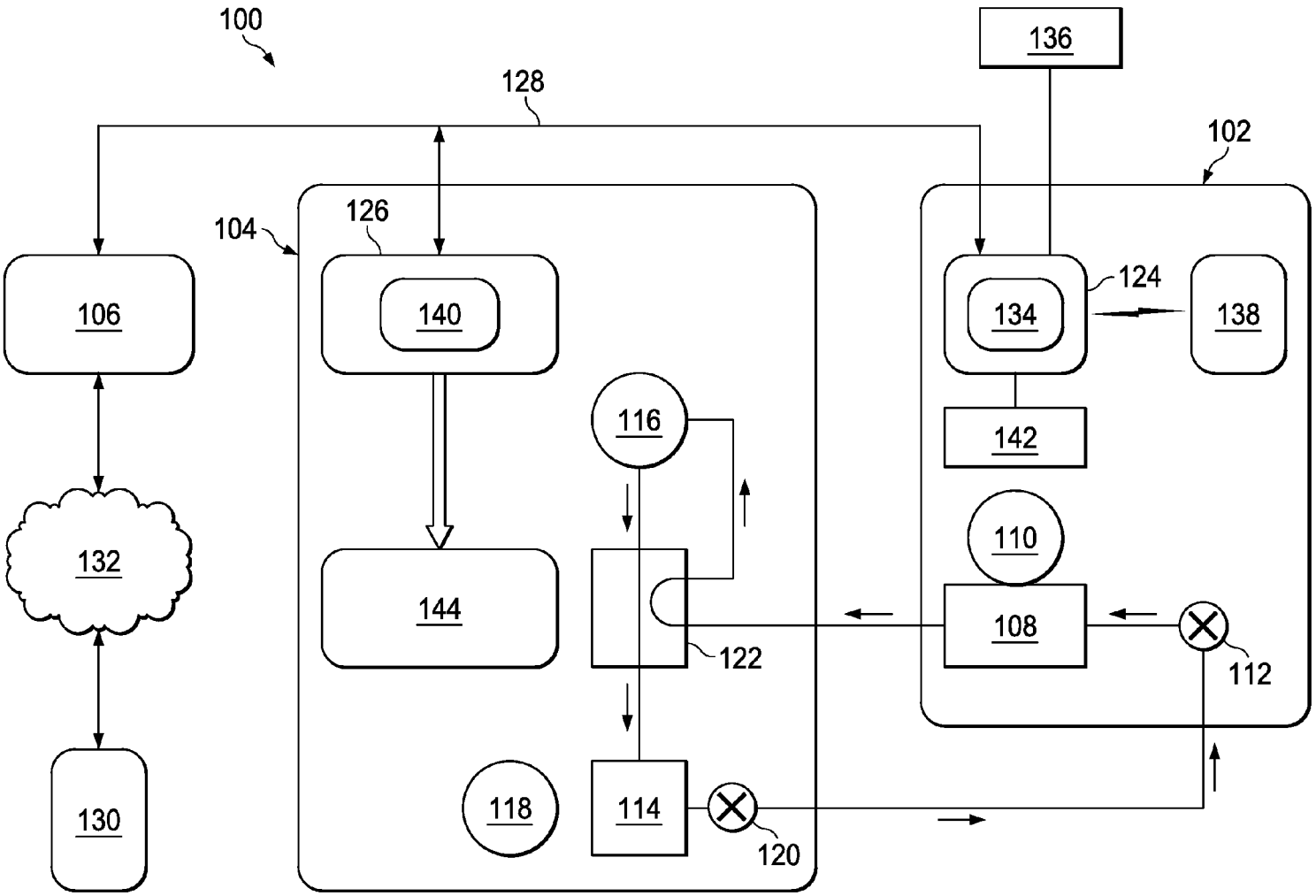
FIG. 1 is a schematic diagram of an HVAC system according to an embodiment of the disclosure.

Referring now to FIG. 1, a schematic diagram of an HVAC system 100 according to an embodiment of this disclosure is shown. HVAC system 100 comprises an indoor unit 102, an outdoor unit 104, and a system controller 106. In some embodiments, the system controller 106 may operate to control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality. In alternative embodiments, the HVAC system 100 may comprise a type of air-conditioning system that is not a heat pump system.

Indoor unit 102 comprises an indoor heat exchanger 108, an indoor fan 110, and an indoor metering device 112.

Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 comprises an outdoor heat exchanger 114, a compressor 116, an outdoor fan 118, an outdoor metering device 120, and a reversing valve 122. Outdoor heat exchanger 114 is a spine fin heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a microchannel heat exchanger, or any other suitable type of heat exchanger.

The compressor 116 is a multiple speed scroll type compressor configured to selectively pump refrigerant at a plurality of mass flow rates. In alternative embodiments, the compressor 116 may comprise a modulating compressor capable of operation over one or more speed ranges, the compressor 116 may comprise a reciprocating type compressor, the compressor 116 may be a single speed compressor, and/or the compressor 116 may comprise any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flowpath of refrigerant in the HVAC system 100 as described in greater detail below. The reversing valve 122 may comprise an electrical solenoid or other device configured to selectively move a component of the reversing valve 122 between operational positions.

The system controller 106 may comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system 100.

In some embodiments, the system controller 106 may selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or other device 130 via a communication network 132. In some embodiments, the communication network 132 may comprise a telephone network and the other device 130 may comprise a telephone. In some embodiments, the communication network 132 may comprise the Internet and the other device 130 may comprise a so-called smartphone and/or other Internet enabled mobile telecommunication device.

The indoor controller 124 may be carried by the indoor unit 102 and may be configured to receive information inputs, transmit information outputs, and otherwise communicate with the system controller 106, the outdoor controller 126, and/or any other device via the communication bus 128 and/or any other suitable medium of communication. In some embodiments, the indoor controller 124 may be configured to communicate with an indoor personality module 134, receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134, or any other suitable information storage device, may comprise information related to the identification and/or operation of the indoor unit 102 and/or a position of the outdoor metering device 120.

In some embodiments, the indoor EEV controller 138 may be configured to receive information regarding temperatures and pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 122 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant may primarily comprise liquid phase refrigerant and the refrigerant may be pumped from the outdoor heat exchanger 114 to the indoor metering device 112 through and/or around the outdoor metering device 120 which does not substantially impede flow of the refrigerant in the cooling mode. The indoor metering device 112 may meter passage of the refrigerant through the indoor metering device 112 so that the refrigerant downstream of the indoor metering device 112 is at a lower pressure than the refrigerant upstream of the indoor metering device 112. The pressure differential across the indoor metering device 112 allows the refrigerant downstream of the indoor metering device 112 to expand and/or at least partially convert to a gaseous phase. The gaseous phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. The refrigerant may thereafter reenter the compressor 116 after passing through the reversing valve 122. In some embodiments, the HVAC system 100 may further comprise a backup and/or emergency heat source such as electric heat strips 109 that may be disposed downstream relative to the indoor heat exchanger 108. In some embodiments, the electric heat strips 109 and the indoor heat exchanger 108 may both be carried within and/or enveloped within an indoor unit cabinet 111.

To operate the HVAC system 100 in the so-called heating mode, the reversing valve 122 may be controlled to alter the flowpath of the refrigerant, the indoor metering device 112 may be disabled and/or bypassed, and the outdoor metering device 120 may be enabled. In the heating mode, refrigerant may flow from the compressor 116 to the indoor heat exchanger 108 through the reversing valve 122, the refrigerant may be substantially unaffected by the indoor metering device 112, the refrigerant may experience a pressure differential across the outdoor metering device 120, the refrigerant may pass through the outdoor heat exchanger 114, and the refrigerant may reenter the compressor 116 after passing through the reversing valve 122. Most generally, operation of the HVAC system 100 in the heating mode reverses the roles of the indoor heat exchanger 108 and the outdoor heat exchanger 114 as compared to their operation in the cooling mode.

Figure 2:
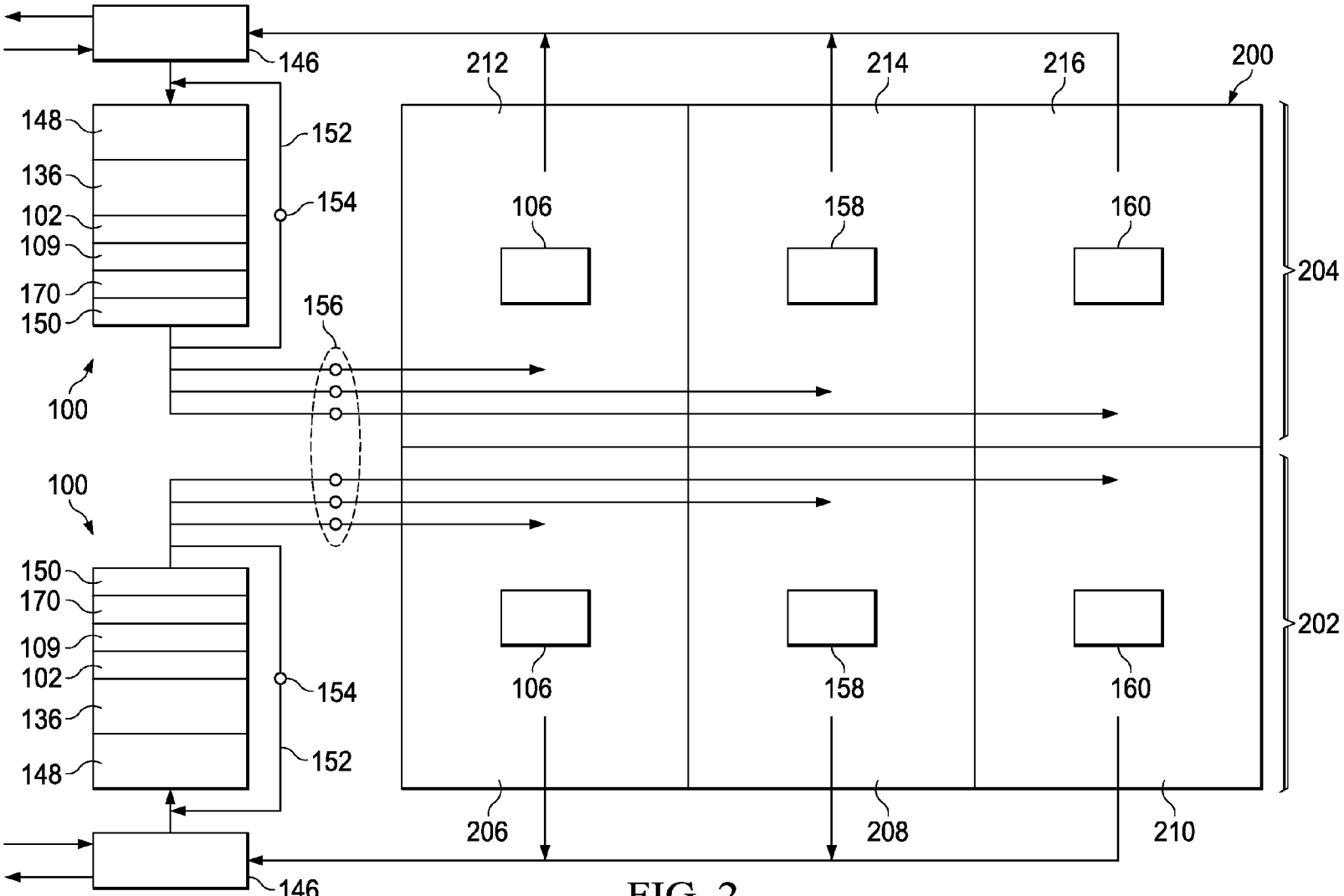
FIG. 2 is a schematic diagram of air circulation paths of a structure conditioned by two HVAC systems of FIG. 1 according to an embodiment of the disclosure.

Referring now to FIG. 2, a schematic diagram of air circulation paths of a structure 200 conditioned by two HVAC systems 100 is shown. In this embodiment, the structure 200 is conceptualized as comprising a lower floor 202 and an upper floor 204. The lower floor 202 comprises zones 206, 208, and 210 while the upper floor 204 comprises zones 212, 214, and 216. The HVAC system 100 associated with the lower floor 202 is configured to circulate and/or condition air of lower zones 206, 208, and 210 while the HVAC system 100 associated with the upper floor 204 is configured to circulate and/or condition air of upper zones 212, 214, and 216.

In addition to the components of HVAC system 100 described above, in this embodiment, each HVAC system 100 further comprises a ventilator 146, a prefilter 148, a humidifier 150, and a bypass duct 152. The ventilator 146 may be operated to selectively exhaust circulating air to the environment and/or introduce environmental air into the circulating air. The prefilter 148 may generally comprise a filter media selected to catch and/or retain relatively large particulate matter prior to air exiting the prefilter 148 and entering the air cleaner 136. The humidifier 150 may be operated to adjust a humidity of the circulating air. The bypass duct 152 may be utilized to regulate air pressures within the ducts that form the circulating air flowpaths. In some embodiments, air flow through the bypass duct 152 may be regulated by a bypass damper 154 while air flow delivered to the zones 206, 208, 210, 212, 214, and 216 may be regulated by zone dampers 156. In some embodiments, the HVAC system 100 may also further comprise a backup and/or emergency heat source such as electric heat strips 109. In some embodiments, the electric heat strips 109 may both be carried by the indoor unit 102.

Still further, each HVAC system 100 may further comprise a zone thermostat 158 and a zone sensor 160. In some embodiments, a zone thermostat 158 may communicate with the system controller 106 and may allow a user to control a temperature, humidity, and/or other environmental setting for the zone in which the zone thermostat 158 is located. Further, the zone thermostat 158 may communicate with the system controller 106 to provide temperature, humidity, and/or other environmental feedback regarding the zone in which the zone thermostat 158 is located. In some embodiments, a zone sensor 160 may communicate with the system controller 106 to provide temperature, humidity, and/or other environmental feedback regarding the zone in which the zone sensor 160 is located.

While HVAC systems 100 are shown as a so-called split system comprising an indoor unit 102 located separately from the outdoor unit 104, alternative embodiments of an HVAC system 100 may comprise a so-called package system in which one or more of the components of the indoor unit 102 and one or more of the components of the outdoor unit 104 are carried together in a common housing or package. The HVAC system 100 is shown as a so-called ducted system where the indoor unit 102 is located remote from the conditioned zones, thereby requiring air ducts to route the circulating air. However, in alternative embodiments, an HVAC system 100 may be configured as a non-ducted system in which the indoor unit 102 and/or multiple indoor units 102 associated with an outdoor unit 104 is located substantially in the space and/or zone to be conditioned by the respective indoor units 102, thereby not requiring air ducts to route the air conditioned by the indoor units 102.

Still referring to FIG. 2, the system controllers 106 may be configured for bidirectional communication with each other and may further be configured so that a user may, using any of the system controllers 106, monitor and/or control any of the HVAC system 100 components regardless of which zones the components may be associated. Further, each system controller 106, each zone thermostat 158, and each zone sensor 160 may comprise a humidity sensor. As such, it will be appreciated that structure 200 is equipped with a plurality of humidity sensors in a plurality of different locations. In some embodiments, a user may effectively select which of the plurality of humidity sensors is used to control operation of one or more of the HVAC systems 100. In some embodiments, the HVAC systems 100 may further comprise a furnace 170 configured to burn fuel such as, but not limited to, natural gas, heating oil, propane, and/or any other suitable fuel, to generate heat.

Figure 3:
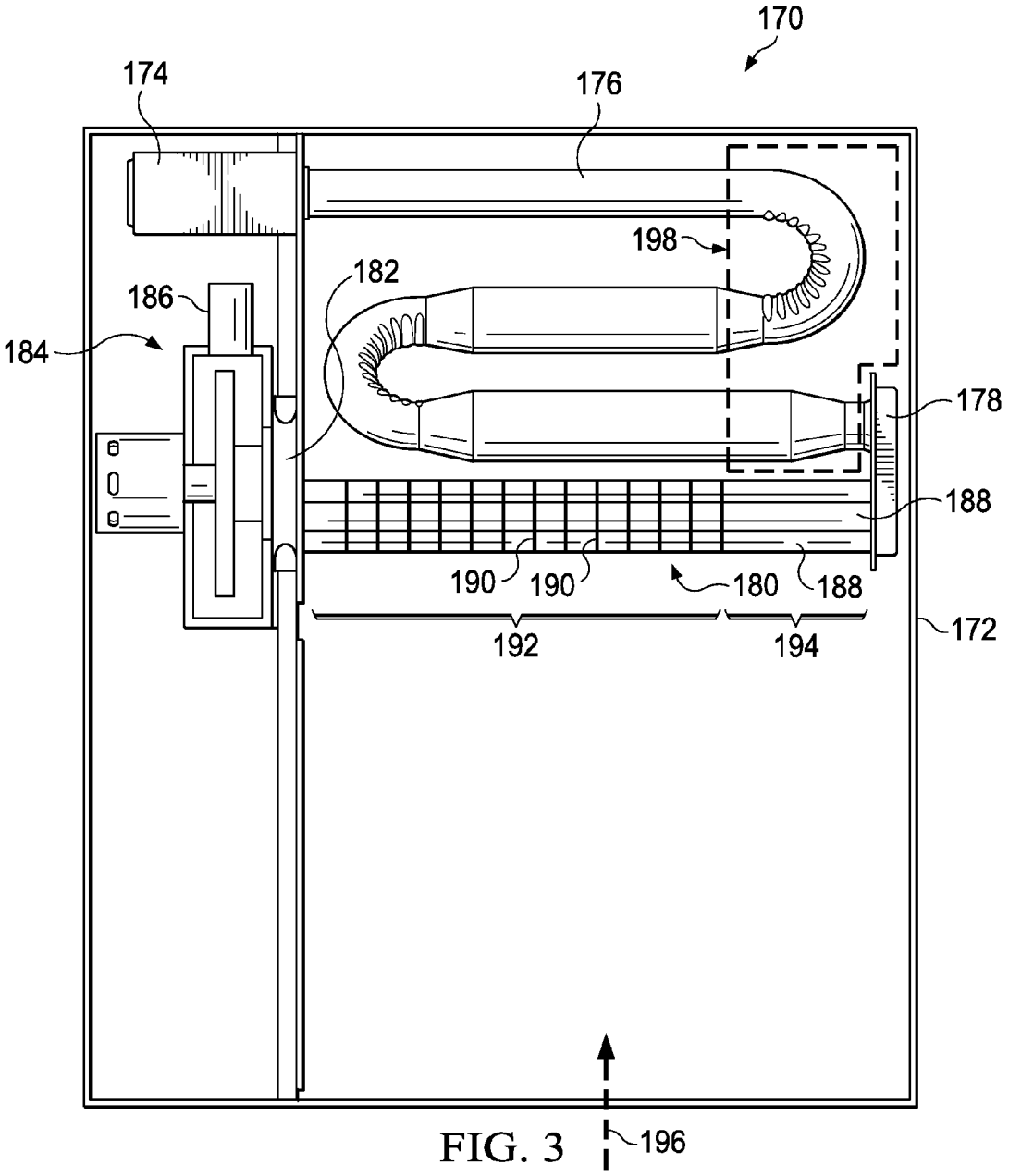
FIG. 3 is a schematic view of a furnace according to an embodiment of the disclosure.

Referring now to FIG. 3, a schematic view of a furnace 170 is shown according to an embodiment of the disclosure. In some cases, the furnace 170 may comprise a furnace cabinet 172 that substantially envelopes a burner box 174. The burner box 174 may generally comprise at least one or more burners. The burner box 174 may also comprise a primary heat exchanger tube 176 that may generally be configured to receive hot exhaust from the burner box 174 and a hot header 178 that may generally be configured to receive the flow of gases from the primary heat exchanger tube 176. In some embodiments, the primary heat exchanger tube 176 may comprise a plurality of U-shaped bends, so that the primary heat exchanger tube 176 passes multiple times across an interior space of the furnace configured to receive an incoming airflow 196. The burner box 174 may also comprise a secondary heat exchanger 180 that may be configured to receive the gases from the hot header 178, a cold header 182 that is configured to receive the gases from the secondary heat exchanger 180, and a draft inducer system 184 that is configured to draw the gases from the burner box 174 through the above-described components before ejecting the gases through an exhaust 186.

In some embodiments, the secondary heat exchanger 180 may generally comprise a fin and tube type heat exchanger that comprises a plurality of tubes 188 connected in fluid communication with the hot header 178 and the cold header 182. The secondary heat exchanger 180 may also comprise a plurality of fins 190 that may generally be connected to the tubes 188 along a finned portion 192 of the secondary heat exchanger 180, while a substantially fewer number of fins 190 may be provided in a low resistance portion 194 of the secondary heat exchanger 180. In some embodiments, the low resistance portion 194 may comprise a higher fin 190 pitch, a higher fin 190 pitch separation distance, and/or a lower density fin 190 arrangement as compared to the finned portion 192. However, in some embodiments, the low resistance portion 194 may comprise substantially no fins 190. In some cases, as a result of incoming airflow 196 passing through the low resistance portion 194, air may generally pass through and/or exit portions of the secondary heat exchanger 180 downstream relative to the low resistance portion 194 with at least one of a higher velocity and/or at a higher mass flow rate as compared to the airflow that exits or passes through the finned portion 192.

Accordingly, a target zone 198 may be located in a portion of the fluid flow path that is associated substantially directly downstream from the low resistance portion 194. The target zone 198 may also encompass portions of the primary heat exchanger tube 176 that may receive relatively more airflow, a higher velocity airflow, and/or a higher mass flow rate of air as compared to a remainder of the airflow output of the secondary heat exchanger 180 (i.e. the airflow passing through the finned portion 192). In some cases, by selectively providing the low resistance air flowpaths through the low resistance portion 194, the above-described resultant airflow characteristics of airflow in the target zone 198 may lessen a need for a baffle or other additional obstructive airflow diverter to alter an airflow characteristic in the target zone 198. Additionally, by providing a low resistance portion 194 of the secondary heat exchanger 180, portions of the primary heat exchanger tube 176 located substantially downstream from the low resistance portion 194 and in the target zone 198 may experience an increased heat transfer rate with the incoming airflow 196 as compared to portions of the primary heat exchanger tube 176 located substantially downstream from the finned portion 192.

Figure 4A:
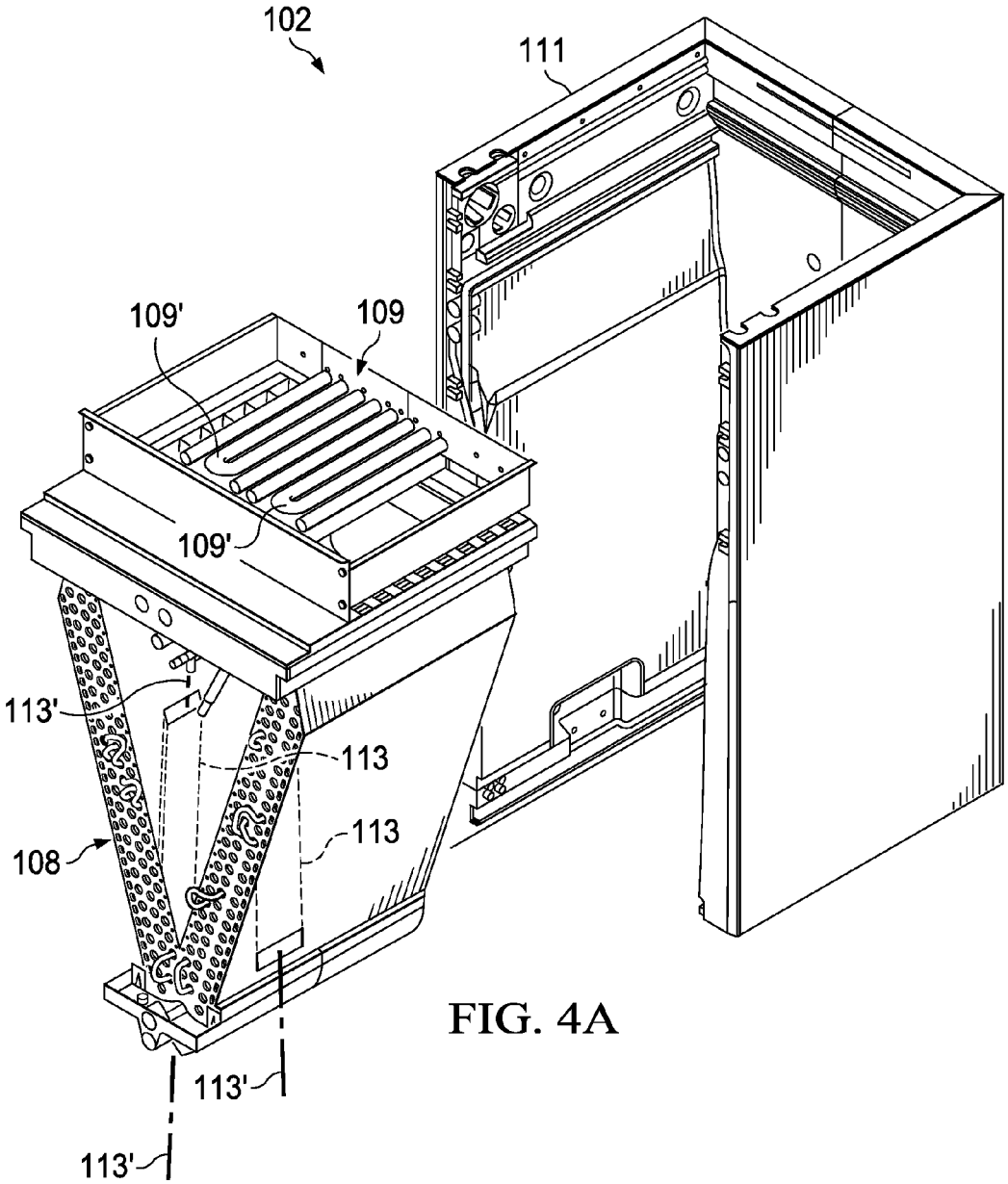
FIG. 4A is an oblique exploded view of an indoor unit according to an embodiment of the disclosure.
Figure 4B:
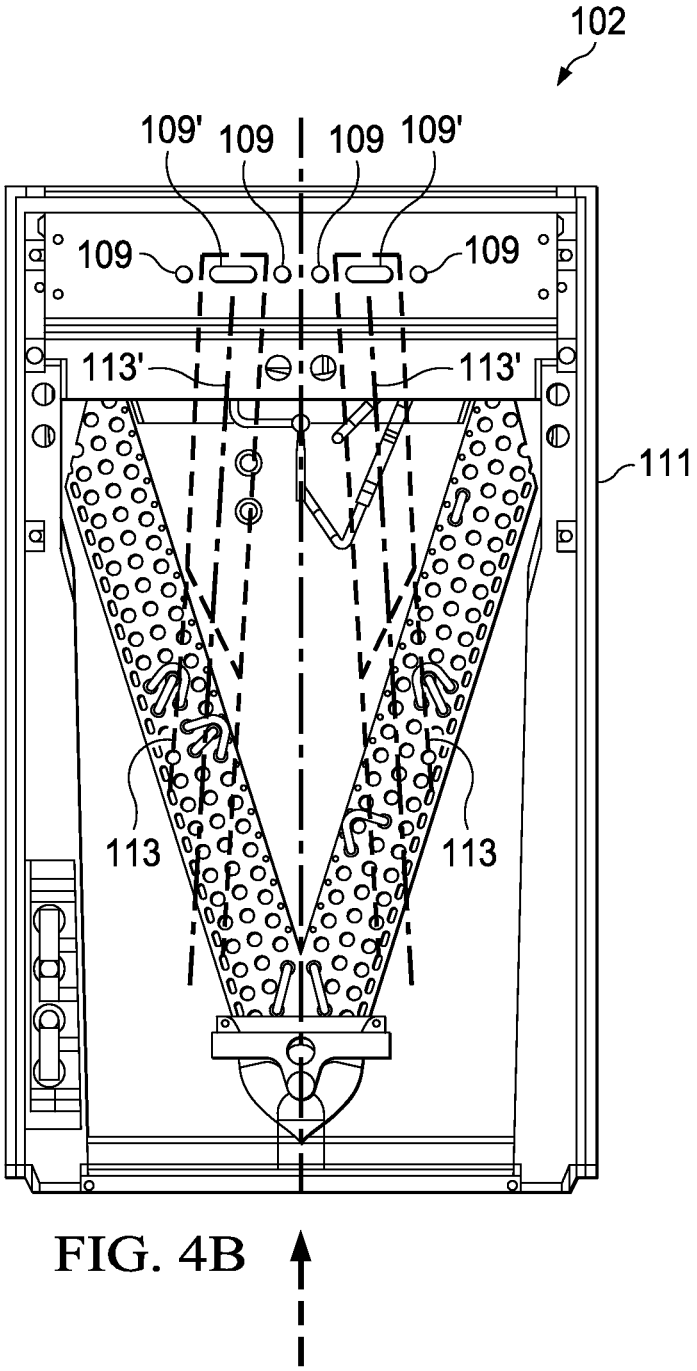
FIG. 4B is an orthogonal front view of the indoor unit according to an embodiment of the disclosure.

Referring now to FIGS. 4A and 4B, an oblique exploded view and an orthogonal front view of an indoor unit 102 are shown, respectively, according to an embodiment of the disclosure. In FIG. 4B, a front barrier is removed to show the electric heat strips 109. In both FIGS. 4A and 4B, front panels of the indoor cabinet 111 are not shown to allow viewing of the indoor heat exchanger 108 and the electric heat strips 109. In some cases, particular portions of the electric heat strips 109 may cause nearby components to experience undesirably high temperatures if not suitably managed. As an example, a bent or curved heating element portion 109' may produce a relatively hotter zone than some other portions of the electric heat strips 109. Accordingly, in some embodiments, the indoor heat exchanger 108, which is a fin and tube type heat exchanger, may comprise one or more low resistance flowpaths 113 through the indoor heat exchanger 108. In this embodiment, the low resistance flowpaths 113 are provided by providing at least one of a reduced amount of fin material, a larger separation distance between adjacent fins, removing fin material, and/or otherwise altering a route of fins and/or tubes to provide a relatively lower resistance path for air to flow through the indoor heat exchanger 108 and to the curved heating element portions 109'.

In some embodiments, the low resistance flowpaths 113 may comprise a substantially shaft-like and/or column-like passage with a longitudinal axis 113' generally directed toward the curved heating element portion 109' or other target zone. In some embodiments, a plurality of low resistance flowpaths 113 may be formed in the indoor heat exchanger 108 and directed at a plurality of curved heating element portions 109' and/or a plurality of different components disposed downstream from the indoor heat exchanger 108. While substantially straight low resistance flowpaths 113 are generally shown in this embodiment, the low resistance flowpaths 113 may generally comprise a straight, curved, frustoconical, and/or any other shaped shaft and/or column-like shape. In operation, by providing the low resistance flowpaths 113 relatively more airflow may be directed to the curved heating element portion 109'. Thus, in some embodiments, the increased airflow to the curved heating element portion 109' may provide an increased heat transfer rate with an incoming airflow as compared to an airflow passing through other portions of the indoor heat exchanger 108.

Figure 5:
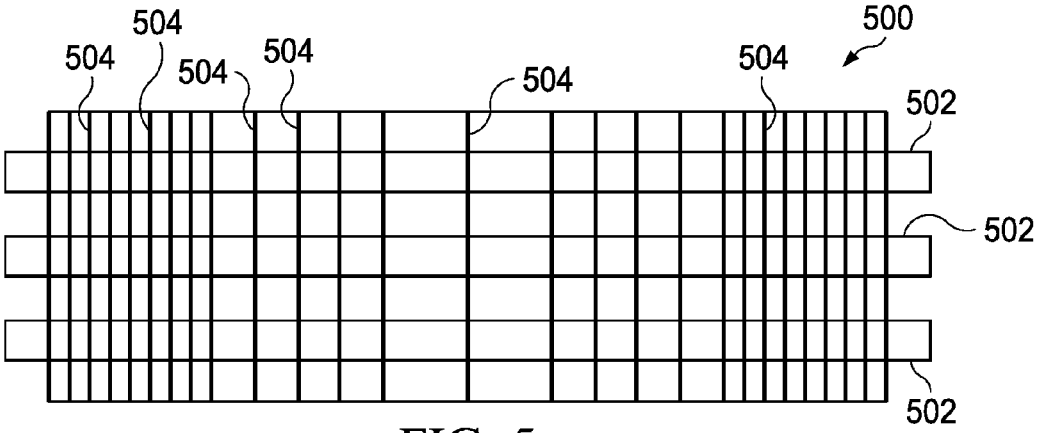
FIG. 5 is an orthogonal view of a heat exchanger according to an embodiment of the disclosure.

Referring now to FIG. 5, an orthogonal view of a heat exchanger 500 is shown according to an embodiment of the disclosure. The heat exchanger 500 may generally comprise a plurality of tubes 502 and a plurality of fins 504. The heat exchanger 500 may comprise a variable fin 504 pitch. In some embodiments, the heat exchanger 500 may comprise a larger fin 504 pitch near the center of the heat exchanger 500. Accordingly, the heat exchanger 500 may comprise a lower fin 504 density arrangement near the center of the heat exchanger 500. The lower density of fins 504 near the center of the heat exchanger 500 may generally provide a lower flow resistance near the center of the heat exchanger 500. Accordingly, the lower flow resistance may reduce the pressure drop experienced by an airflow flowing through the low density fin 504 portion of the heat exchanger 500. Additionally, components located substantially downstream from the lower density arrangement of fins 504 may experience a higher rate of heat transfer as compared to components located substantially downstream from a portion of the heat exchanger 500 that comprise a higher density fin 504 arrangement. Alternatively, it will be appreciated that heat exchanger 500 may also comprise a variable fin 504 pitch that comprises a larger fin 504 pitch in various locations along the heat exchanger 500 to promote heat transfer with a heat transfer component disposed substantially downstream from the portion of the heat exchanger 500 comprising the larger fin 504 pitch distance.

Figure 6:
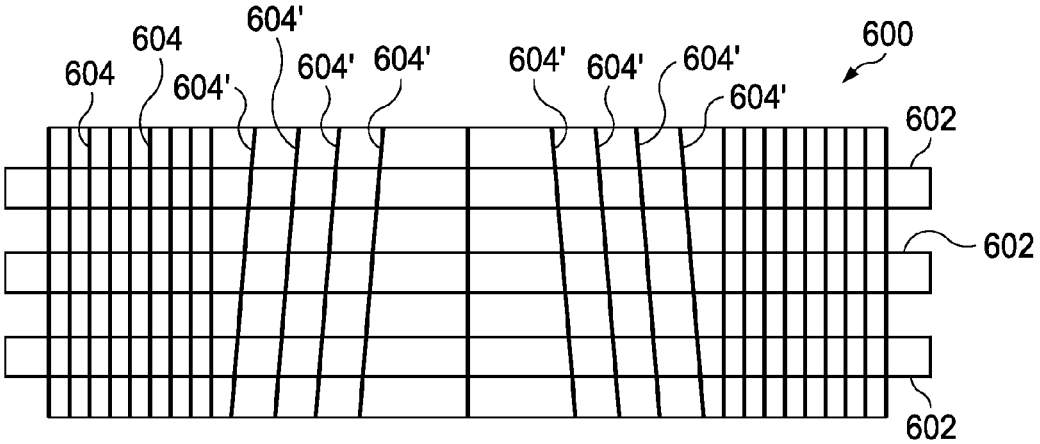
FIG. 6 is an orthogonal view of a heat exchanger according to another embodiment of the disclosure.

Referring now to FIG. 6, an orthogonal view of a heat exchanger 600 is shown according to another embodiment of the disclosure. The heat exchanger 600 may generally comprise a plurality of tubes 602 and a plurality of fins 604. The heat exchanger 600 may comprise a variable fin 604 pitch. In some embodiments, the heat exchanger 600 may comprise a larger fin 604 pitch near the center of the heat exchanger 600. Accordingly, the heat exchanger 600 may comprise a lower fin 604 density arrangement near the center of the heat exchanger 600. Additionally, fins 604' may also be generally angled to provide a directional and/or central focus for the output airflow passing through the heat exchanger 600, which may, at least in some embodiments, potentially comprise a higher mass flow rate and/or higher velocity near a central output of the heat exchanger 600. Accordingly, in some embodiments, heat exchanger 600 may comprise a substantially straight, higher density fin 604 arrangement near the left and right sides of the heat exchanger 600, while the heat exchanger 600 may comprise a lower density of angled fins 604' near the center of the heat exchanger 600. The lower density of fins 604' near the center of the heat exchanger 600 may generally provide a lower flow resistance near the center of the heat exchanger 600. Accordingly, the lower flow resistance may reduce the pressure drop experienced by an airflow flowing through the low density fin 604' portion of the heat exchanger 600. Additionally, components located substantially downstream from the lower density arrangement of fins 604' may experience a higher rate of heat transfer as compared to components located substantially downstream from a portion of the heat exchanger 600 that comprise a higher density fin 604 arrangement. Further, the angled configuration of fins 604' may direct an airflow in a direction commensurate with the angle of the fins 604' and towards a component and/or a portion of a component disposed downstream from the heat exchanger 600 to promote heat transfer with the component and/or the portion of the component.

Figure 7:
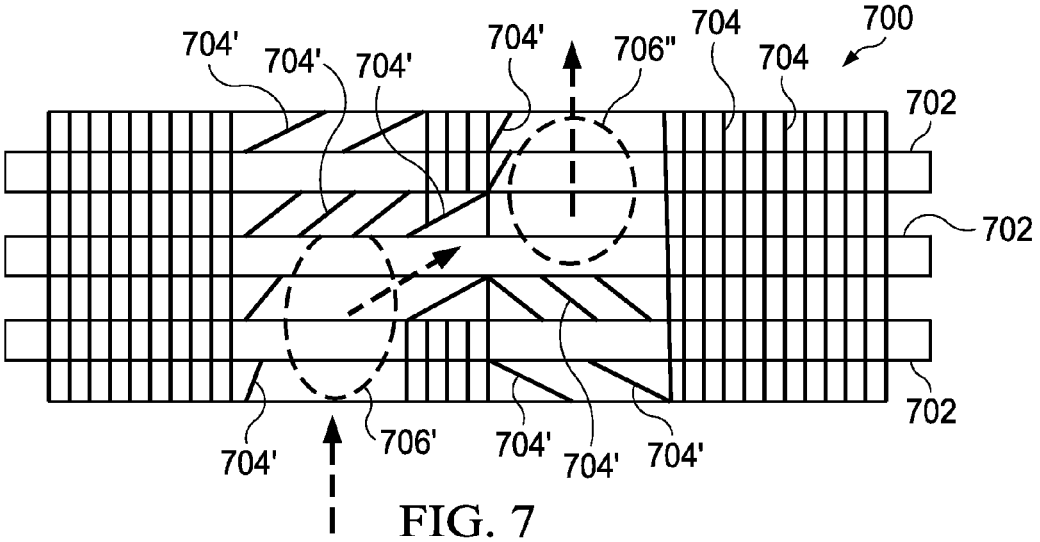
FIG. 7 is a schematic cut-away view of a heat exchanger according to an alternative embodiment of the disclosure.

Referring now to FIG. 7, a schematic cut-away view of a heat exchanger 700 is shown according to an alternative embodiment of the disclosure. The heat exchanger 700 may generally comprise a plurality of tubes 702 and a plurality of fins 704. In some embodiments, the heat exchanger 700 may comprise a plurality of angled fins 704' that are angled to encourage and/or promote movement of air from a first cavity 706' and/or channel to a second cavity 706" and/or channel, thereby at least one of providing a lower resistance flowpath and/or directionally redirecting a flow of air through the heat exchanger 700. Accordingly, the lower flow resistance may reduce the pressure drop experienced by an airflow flowing through the cavities 706', 706" of the heat exchanger 700. Additionally, components located substantially downstream from the second cavity 706" may experience a higher rate of heat transfer as compared to components located substantially downstream from a portion of the heat exchanger 700 that do not comprise a lower flow resistance path. Further, the angled configuration of fins 704' may direct an airflow in a direction commensurate with the angle of the fins 704' and towards a component and/or a portion of a component disposed downstream of the heat exchanger 700 to promote heat transfer with the component and/or the portion of the component.

Figure 8:
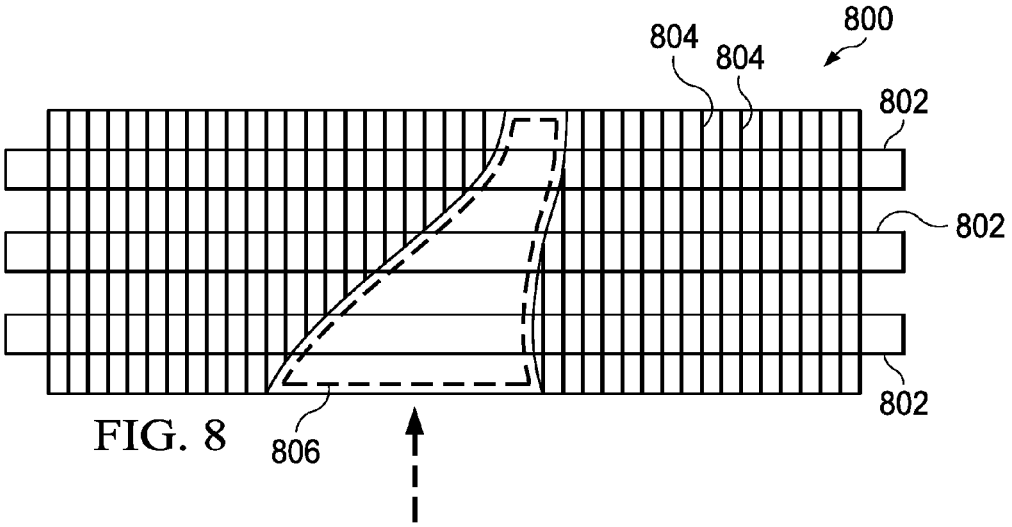
FIG. 8 is a schematic cut-away view of a heat exchanger according to another alternative embodiment of the disclosure.

Referring now to FIG. 8, a schematic cut-away view of a heat exchanger 800 is shown according to another alternative embodiment of the disclosure. The heat exchanger 800 may generally comprise a plurality of tubes 802 and a plurality of fins 804. In some embodiments, the fins 804 may generally be removed from a volumetric and/or three dimensional substantially lower resistance flowpath 806. In this embodiment, the lower resistance flowpath 806 may comprise a generally funnel and/or vortex shape that extends from one end of the heat exchanger 800 and narrows towards an opposing end of the heat exchanger 800, while in other embodiments, the lower resistance flowpath 806 may comprise any other shaped space, zone, cavity, channel, and/or passage where lower resistance to airflow through the heat exchanger 800 is provided by managing a number, location, orientation, and/or other feature of a fin 804 and/or tube 802. In some embodiments, the shape of the lower resistance flowpath 806 may be configured to direct an airflow through the heat exchanger 800 towards a component and/or a portion of a component disposed downstream of the heat exchanger 800 to promote heat transfer with the component and/or the portion of the component.

Figure 9:
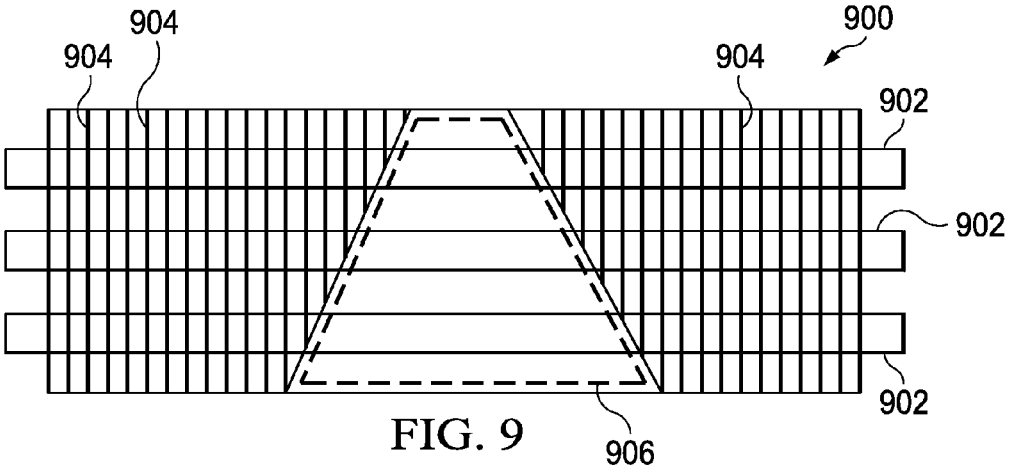
FIG. 9 is a schematic cut-away view of a heat exchanger according to yet another alternative embodiment of the disclosure.

Referring now to FIG. 9, a schematic cut-away view of a heat exchanger 900 is shown according to yet another alternative embodiment of the disclosure. The heat exchanger 900 may generally comprise a plurality of tubes 902 and a plurality of fins 904. In some embodiments, the fins 904 may generally be removed from a volumetric and/or three dimensional substantially lower resistance flowpath 906. In this embodiment, the lower resistance flowpath 906 may comprise a generally frustoconical shape, while in other embodiments, the lower resistance flow space may comprise any other shaped space, zone, cavity, channel, and/or passage where lower resistance to airflow through the heat exchanger 900 is provided by managing a number, location, orientation, and/or other feature of a fin 904 and/or tube 902. In some embodiments, the shape of the lower resistance flowpath 906 may be configured to direct an airflow through the heat exchanger 900 towards a component and/or a portion of a component disposed downstream of the heat exchanger 900 to promote heat transfer with the component and/or the portion of the component.

Figure 10:
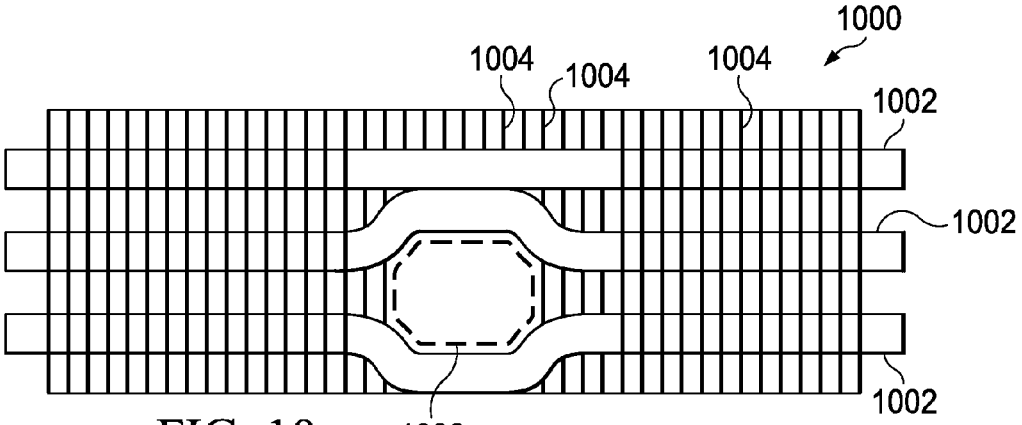
FIG. 10 is an orthogonal view of a heat exchanger according to still yet another alternative embodiment of the disclosure.

Referring now to FIG. 10, an orthogonal end view of a heat exchanger 1000 is shown according to still yet another alternative embodiment of the disclosure. The heat exchanger 1000 may generally comprise a plurality of tubes 1002 and a plurality of fins 1004. In some embodiments, a lower resistance flowpath 1006 may be formed by excluding a plurality of fins 1004 and/or tubes 1002 from the lower resistance flowpath 1006. In this embodiment, the tubes 1002 are bent and/or otherwise configured to extend around the lower resistance flowpath 1006 rather than through the lower resistance flowpath 1006. In some embodiments, the shape of the lower resistance flowpath 1006 may be configured to direct an airflow through the heat exchanger 1000 towards a component and/or a portion of a component disposed downstream of the heat exchanger 1000 to promote heat transfer with the component and/or the portion of the component.

While some of the above-described embodiments are explained primarily as being useful for influencing a characteristic of an airflow output of a heat exchanger, the same principles of adjusting heat exchanger fin content and fin features may be utilized to cause changes in airflow characteristics upstream of the heat exchanger. In some embodiments, by increasing and/or decreasing an airflow resistance of a localized portion of a heat exchanger, airflow may tend to homogenize, recirculate, alter a directional path, and/or otherwise react to the structure of the heat exchanger so that one or more components upstream relative to the heat exchanger may receive relatively more or less airflow and/or any other desired change in airflow characteristic local to components. Accordingly, by providing one or more of the heat exchangers disclosed herein, upstream and/or downstream airflow characteristics may be controlled and/or utilized to manage temperatures of selected components. Additionally, by partially finning a fin and tube heat exchanger as disclosed herein, external fluid flow distribution through any of the heat exchanger embodiments disclosed herein may be controlled and designed to achieve an optimum flow distribution, which may, at least in some embodiments, increase heat transfer with a component and/or a portion of a heat transfer component disposed substantially downstream from the heat exchanger.

Figure 11:
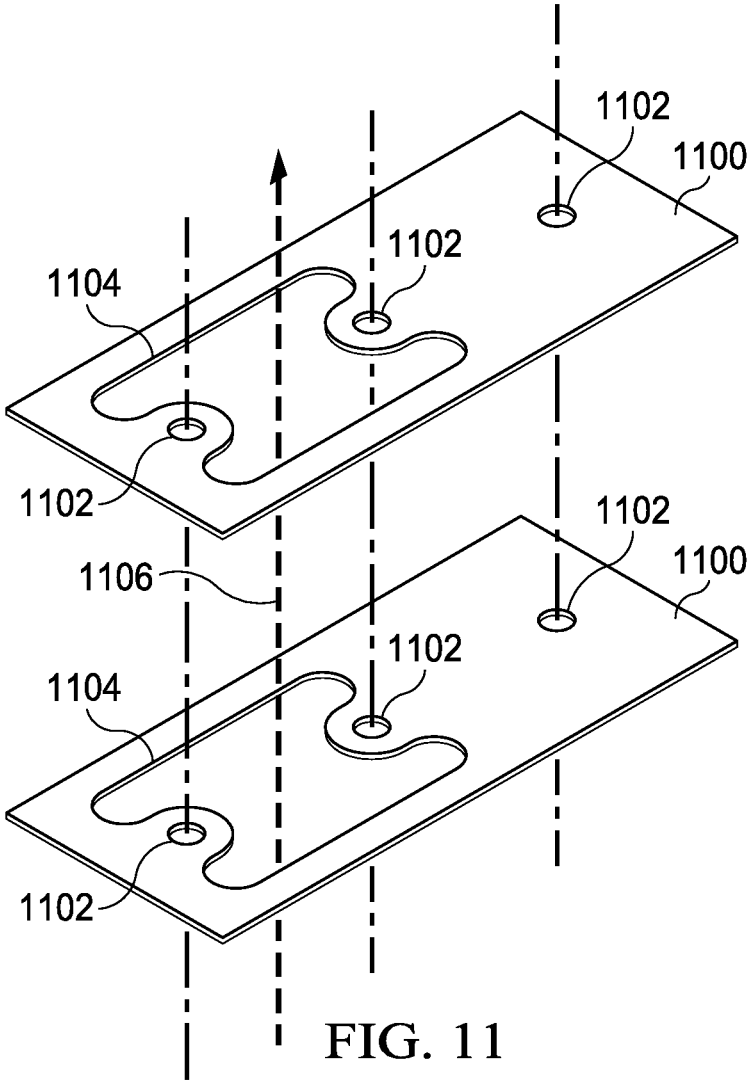
FIG. 11 is an oblique view of a plurality of fins according to an embodiment of the disclosure.

Referring now to FIG. 11, an oblique view of a plurality of fins 1100 is shown according to an embodiment of the disclosure. In some cases, one or more of the above-described heat exchangers may be formed by first stacking a plurality of fins 1100 into a finstack arrangement so that tube apertures 1102 are aligned to receive a refrigerant tube that may later be expanded into an interference fit with the tube apertures 1102. In some cases, pressure apertures 1104 may be provided on fins 1100 so that when the fins 1100 are assembled into the finstack arrangement, the pressure apertures 1104 form a lower resistance flowpath 1106 through the finstack arrangement. In some embodiments, the lower resistance flowpath 1106 may be configured to provide a reduced pressure drop to an airflow passing through the finstack arrangement. In some embodiments, however, the lower resistance flowpath 1106 may be configured to direct an airflow through a heat exchanger towards a component and/or a portion of a component disposed downstream of the heat exchanger to promote an increased heat transfer with the component and/or the portion of the component.

Figure 12:
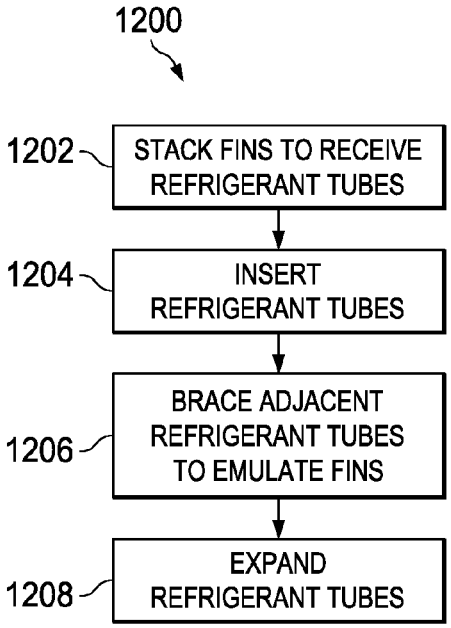
FIG. 12 is a method of producing a fin and tube heat exchanger according to an embodiment of the disclosure.

Referring now to FIG. 12, a method 1200 of producing a fin and tube heat exchanger is shown according to an embodiment of the disclosure. The method 1200 may begin at block 1202 by stacking a plurality of fins into alignment to receive refrigerant tubes through refrigerant apertures in the fins. The method 1200 may continue at block 1204 by inserting refrigerant tubes through the refrigerant apertures of the fins. The method 1200 may continue at block 1206 by laterally bracing adjacent refrigerant tubes. In some embodiments, the lateral bracing may be provided by inserting metallic shims, bands, a wax-like material that may be easily formed for insertion and/or melted for removal, and/or any other suitable material between adjacent refrigerant tubes so that when the refrigerant tubes are expanded into an interference fit with the refrigerant tube apertures of the fins, the bracing material reacts substantially similarly to the material of the fins. In some embodiments, the bracing material may be localized near portions of the stack of fins where a low resistance flowpath is provided by a lower presence of fin material. In some cases, the bracing material may be configured between adjacent refrigerant tubes so that both tensile and compression forces applied to the bracing material emulate a response a fin having now low resistance flowpath feature may otherwise provide. The method 1200 may continue at block 1208 by expanding the refrigerant tubes, thereby providing an interference fit between the fins and the refrigerant tubes. In some embodiments, the above-described bracing may reduce an amount of skewing of the refrigerant tubes relative to each other and otherwise provide an even and controlled force distribution as the refrigerant tubes are expanded. It will be appreciated that by removing fin material from a heat exchanger to provide a differentiated resistance flowpath, special manufacturing techniques of assembling a heat exchanger may be necessary to prevent skewing, warpage, and or other damage caused by interference fits between tubes extending through adjacent fins. This method 1200 contemplates such techniques.

Figure 13:
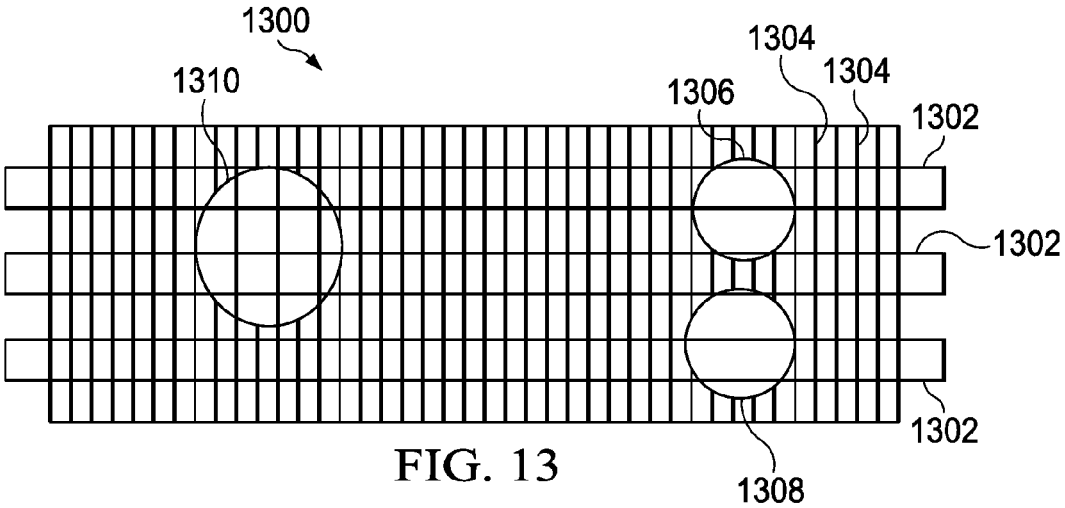
FIG. 13 a schematic cut-away view of a heat exchanger according to an embodiment of the disclosure.

Referring now to FIG. 13, a schematic cut-away view of a heat exchanger 1300 is shown according to an embodiment of the disclosure. The heat exchanger 1300 may generally comprise a plurality of tubes 1302 and a plurality of fins 1304. In some embodiments, the heat exchanger 1300 may comprise a first cavity 1306 that is substantially surrounded by fins 1304 and a second cavity 1308 that is substantially surrounded by fins 1304. Further, the first cavity 1306 and the second cavity 1308 may comprise substantially no fins 1304 disposed within the cavities 1306, 1308 as a result of at least one of the size, shape, and or design requirements of the cavities 1306, 1308.

In some embodiments, the heat exchanger 1300 may also comprise a third cavity 1310. While the first and second cavities 1306, 1308 comprise substantially no fins 1304 within the cavities 1306, 1308, the third cavity 1310 may generally comprise fins 1304 disposed within the cavity 1310 that may generally comprise a greater fin 1304 pitch and/or separation distance between adjacent fins 1304 than the remainder of the fins 1304 in the heat exchanger 1300. In some embodiments, the third cavity 1310 may comprise fins 1304 as a result of a larger size, less complex shape, and/or the airflow design requirements of the third cavity 1310 and or the first and second cavities 1306, 1308. The cavities 1306, 1308, 1310 may at least provide a lower resistance flowpath through the heat exchanger 1300 and/or directionally redirect a flow of air through the heat exchanger 1300. In some embodiments, the different cavities 1306, 1308, 1310 may be configured to direct an airflow through the heat exchanger 1300 towards different components and/or portions of a component disposed downstream of the heat exchanger 1300 to promote heat transfer with the component and/or the portion of the component. As previously stated, in some embodiments, the lower resistance flowpath provided by cavities 1306, 1308, 1310 may increase a heat transfer rate with a component disposed downstream of the heat exchanger 1300.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heat exchanger, comprising:

a finned portion; and a first differentiated resistance flowpath comprising at least one of (1) a reduced amount of fin material in the first differentiated resistance flowpath relative to the finned portion of the heat exchanger or (2) a reduced amount of refrigerant tube material in the first differentiated resistance flowpath relative to the finned portion of the heat exchanger;

wherein the first differentiated resistance flowpath is configured to direct at least a portion of an airflow through the heat exchanger towards at least a portion of a component disposed downstream from the first differentiated resistance flowpath of the heat exchanger, and wherein the portion of the component disposed downstream from the first differentiated resistance flowpath of the heat exchanger comprises an increased heat transfer rate with the airflow as compared to other portions of the component disposed downstream from the finned portion of the heat exchanger.

2. The heat exchanger of claim 1, wherein the first differentiated resistance flowpath comprises no fin material.

3. An HVAC system, comprising:

a heat exchanger, comprising:

a finned portion; and a first differentiated resistance flowpath comprising at least one of (1) a reduced amount of fin material in the first differentiated resistance flowpath relative to the finned portion of the heat exchanger or (2) a reduced amount of refrigerant tube material in the first differentiated resistance flowpath relative to the finned portion of the heat exchanger;

wherein the first differentiated resistance flowpath is configured to direct at least a portion of an airflow through the heat exchanger towards at least a portion of a component disposed downstream from the first differentiated resistance flowpath of the heat exchanger, and wherein the portion of the component disposed downstream from the first differentiated resistance flowpath of the heat exchanger comprises an increased heat transfer rate with the airflow as compared to other portions of the component disposed downstream from the finned portion of the heat exchanger.

4. The HVAC system of claim 3, wherein the first differentiated resistance flowpath comprises no fin material.

5. The heat exchanger of claim 2, wherein the first differentiated resistance flowpath comprises a three dimensional lower resistance flowpath.

6. The heat exchanger of claim 5, wherein the first differentiated resistance flowpath is configured to provide at least one of a higher velocity and a higher mass flow rate of the airflow exiting the heat exchanger as compared to the airflow exiting other portions of the heat exchanger.

7. The heat exchanger of claim 5, wherein the first differentiated resistance flowpath comprises a substantially vortex profile that extends from one end of the heat exchanger and narrows towards an opposing downstream end of the heat exchanger.

8. The heat exchanger of claim 5, wherein the first differentiated resistance flowpath comprises a substantially frustoconical profile that extends from one end of the heat exchanger and narrows towards an opposing downstream end of the heat exchanger.

9. The heat exchanger of claim 1, wherein the heat exchanger is a secondary heat exchanger of a furnace.

10. The heat exchanger of claim 9, wherein the component is a primary heat exchanger of a furnace.

11. The HVAC system of claim 3, wherein the first differentiated resistance flowpath comprises a three dimensional lower resistance flowpath.

12. The HVAC system of claim 11, wherein the first differentiated resistance flowpath is configured to provide at least one of a higher velocity and a higher mass flow rate of the airflow exiting the heat exchanger as compared to the airflow exiting other portions of the heat exchanger.

13. The HVAC system of claim 11, wherein the first differentiated resistance flowpath comprises a substantially vortex profile that extends from one end of the heat exchanger and narrows towards an opposing downstream end of the heat exchanger.

14. The HVAC system of claim 11, wherein the first differentiated resistance flowpath comprises a substantially frustoconical profile that extends from one end of the heat exchanger and narrows towards an opposing downstream end of the heat exchanger.

15. The HVAC system of claim 3, wherein the heat exchanger is a secondary heat exchanger of a furnace.

16. The HVAC system of claim 15, wherein at least one tube of the heat exchanger is in fluid communication with a hot header at a first end and a cold header at an opposing end.

17. The HVAC system of claim 15, wherein the component is a primary heat exchanger of a furnace.

18. The HVAC system of claim 17, wherein the portion of the primary heat exchanger of the furnace disposed downstream from the first differentiated resistance flowpath comprises an increased heat transfer rate with the airflow as compared to other portions of the primary heat exchanger disposed downstream from the finned portion.

* * * * *